US005720068A

United States Patent [19]

Clark et al.

[11] Patent Number: 5,720,068

[45] Date of Patent: Feb. 24, 1998

[54] AUTOMATIC SWIMMING POOL CLEANERS AND ASSOCIATED COMPONENTS

[75] Inventors: William T. Clark, Coral Springs; James D. Scott, II, Boca Raton; Graham M. Barton, Tamarac; Chris A. Rice, Boca Raton; Shawn M. McLaughlin, Delray Beach, all of Fla.

[73] Assignee: Baracuda International Corporation, Ft. Lauderdale, Fla.

[21] Appl. No.: 671,099

[22] Filed: Jun. 28, 1996

Related U.S. Application Data

[63] Continuation of Ser. No. 331,349, Oct. 28, 1994, abandoned.

[51] Int. Cl.[6] ..... F04H 3/20; F16K 17/00

[52] U.S. Cl. ..... 15/1.7; 137/114; 137/907

[58] Field of Search ..... 15/1.7, 363, 374, 15/420, 364–373, 385–394, 399, 401, 402, 422, 417, 114; 137/907

[56] References Cited

U.S. PATENT DOCUMENTS

| | | | |
|---|---|---|---|
| 1,034,260 | 7/1912 | Lichtenberg | 15/364 |
| 2,027,543 | 1/1936 | Lofgren | 15/420 |
| 2,280,751 | 4/1942 | Davis | 15/364 |
| 3,046,583 | 7/1962 | Drennan | 15/1.7 |
| 3,229,315 | 1/1966 | Watson | 15/1.7 |
| 3,243,830 | 4/1966 | Conrad | 15/1.7 |
| 3,753,265 | 8/1973 | Wulc | 15/1.7 |
| 4,100,641 | 7/1978 | Pansini | 15/1.7 |
| 4,254,525 | 3/1981 | Combest | 15/1.7 |
| 4,275,474 | 6/1981 | Woodard | 15/1.7 |
| 4,378,254 | 3/1983 | Chauvier | 15/1.7 |
| 4,835,809 | 6/1989 | Roumagnac | 15/1.7 |
| 5,337,434 | 8/1994 | Erlich | 15/1.7 |
| 5,351,709 | 10/1994 | Vos | 15/1.7 |
| 5,400,467 | 3/1995 | Hwang | 15/401 |

FOREIGN PATENT DOCUMENTS

| | | | |
|---|---|---|---|
| 0 357 810 A1 | 3/1990 | European Pat. Off. . | |
| 0 380 421 A1 | 8/1990 | European Pat. Off. . | |
| 0 543 387 A2 | 5/1993 | European Pat. Off. . | |
| 2365935 | 4/1978 | France | 15/180 |
| 49568 | 3/1993 | Japan | 15/363 |
| 139590 | 3/1953 | Sweden | 15/367 |

*Primary Examiner*—Gary K. Graham

*Attorney, Agent, or Firm*—Dean W. Russell; Kilpatrick Stockton LLP

[57] ABSTRACT

Automatic swimming pool cleaning systems are disclosed. The systems include an automatic swimming pool cleaner incorporating one or more curved wipers protruding from its lower surface. The wipers and flat bottom of the cleaner induce a vortex as fluid flows to its central inlet, entraining debris in the flow. A fluted throat surrounding the inlet additionally assists the interior of the base of the cleaner in retaining debris when opened for cleaning, additionally providing an improved flow path for enhanced debris pick-up. Also disclosed is a valve useful for controlling and indicating the rate of fluid flow to a cleaner. Included within the valve is a plunger attached to a spring, with the spring force opposing fluid flow through the valve. Flow sufficient to overcome the spring force compresses the spring, however, thereby moving the plunger within the tube and providing a dynamic indication of the rate of fluid flow. A diffuser and fluid release ports permit the valve to be adjusted to achieve a desired flow rate.

13 Claims, 4 Drawing Sheets

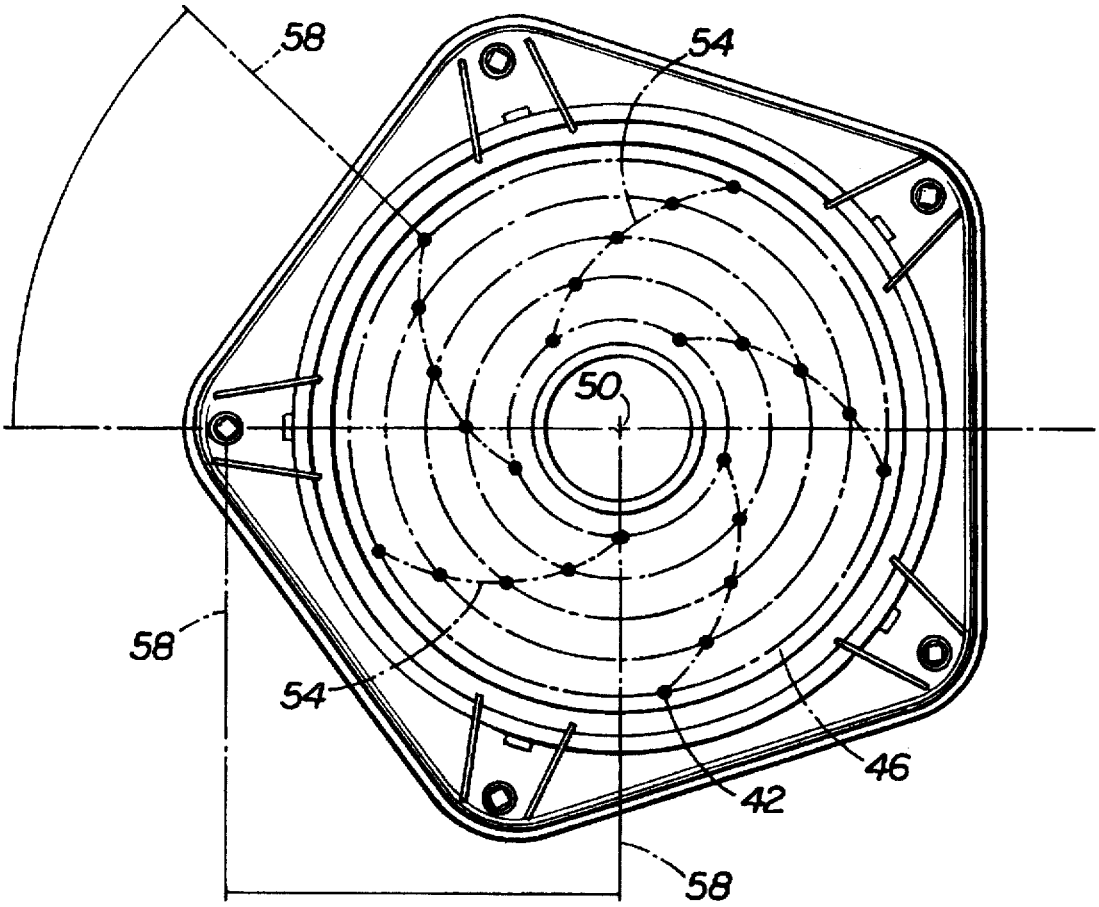
FIG 3
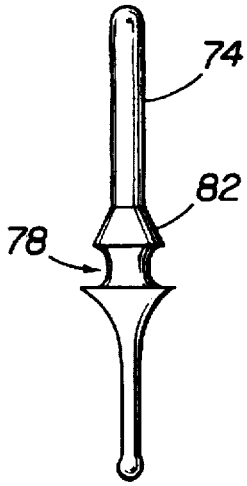
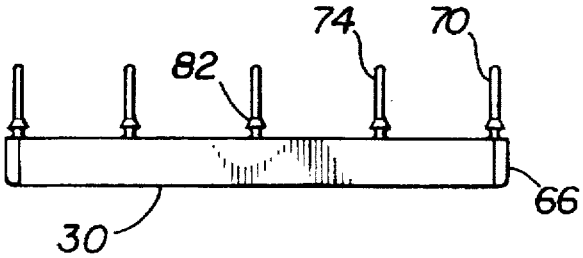
FIG 4
FIG 4A

AUTOMATIC SWIMMING POOL CLEANERS AND ASSOCIATED COMPONENTS

This is a continuation of application Ser. No. 08/331,349 filed on Oct. 28, 1994 now abandoned

FIELD OF THE INVENTION

This invention relates to automatic swimming pool cleaners and to valves and other components of or associated with such cleaners.

BACKGROUND OF THE INVENTION

U.S. Pat. No. 4,835,809 to Roumagnac, incorporated herein in its entirety by this reference, discloses various embodiments of an automatic device for cleaning swimming pools. The device includes a brush attached either to the lower edge or the bottom of its body to contact surfaces of the swimming pool and displace debris positioned there. According to the Roumagnac patent, the brush may be arched and of "substantially the same shape and length of the lower edge" of the body, for example, or "in the form of a circular cordon attached to the periphery of the bottom." Also included in the body of the device is an aspiration orifice, which may be annular, as shown in FIG. 5 of the Roumagnac patent, or "in the form of a narrow arched window" of FIG. 3.

SUMMARY OF THE INVENTION

The present invention provides an improved version of the device described in the Roumagnac patent. Rather than positioning a brush near the underside of the device, the cleaner of the present invention includes a series of curved wipers protruding from its lower surface. The wipers spiral inward toward a central inlet, causing water or other fluid encountering them to flow in the form of a vortex about the inlet when the cleaner operates. The arrangement of the wipers, together with the flat bottom of the cleaner, function to accelerate fluid flow toward the inlet, increasing the likelihood that debris entrained in the flow will remain suspended therein until entering the cleaner itself. All (or substantially all) radii of the cleaner centered at the inlet cross at least one wiper, moreover, so that the wipers effectively block fluid and debris from entering the inlet without having been captured by the vortex.

The cleaner of the present invention also defines a fluted throat surrounding the central inlet. Fluting the throat assists the interior of the base of the cleaner in retaining fluid and debris even when the cleaner is opened. This retention in turn facilitates orderly emptying of the cleaner, avoiding substantial fluid leakage when the interior of the cleaner is exposed. The present invention also provides access to the filter placed within the cleaner merely by removing the upper portion of the device.

Additionally included as part of the present invention is a valve for controlling and indicating the rate of fluid flow to an automatic swimming pool cleaner. The generally-tubular valve contains an internal plunger attached to a spring (or other resilient device) opposing fluid flow therethrough. Flow sufficient to overcome the spring force compresses the spring, thereby moving the plunger within the tube. By making the tube transparent, the relative position of the plunger may be used as a visual indicator of the rate of fluid flow through the valve.

Intermediate the inlet and plunger are one or more ports designed to release excess fluid when necessary to achieve a desired flow rate through the valve. The effective size of the ports, furthermore, is adjustable to vary the amount of fluid released as a function of time. The released fluid is then transferred into a tubular diffuser surrounding the corrugated hose typically attached to the outlet of the valve, with the corrugations acting to reduce the velocity and pressure of the released fluid before it exits the diffuser. The valve of the present invention is not limited to use in connection with corrugated hose, however, and may be employed successfully in other systems as well.

It is therefore an object of the present invention to provide an automatic swimming pool cleaner having multiple curved wipers protruding from its lower surface.

It is another object of the present invention to provide a pool cleaner in which the wipers spiral inward toward a central inlet.

It is also an object of the present invention to provide a pool cleaner which induces fluid to flow in a vortex entering the cleaner.

It is a further object of the present invention to provide an automatic swimming pool cleaner with a fluted throat defining the fluid inlet.

It is yet another object of the present invention to provide a valve for controlling and indicating the rate of fluid flow to an automatic swimming pool cleaner.

It is an additional object of the present invention to provide a valve including an internal plunger attached to a spring opposing fluid flow therethrough.

It is also an object of the present invention to provide a valve including fluid release ports and a diffuser for reducing the pressure and velocity of the released fluid.

Other objects, features, and advantages of the present invention will become apparent with reference to the remainder of the written portion and the drawings of this application.

BRIEF DESCRIPTION OF THE DRAWINGS

FIG. 3 is a top plan view of the lower section of the body of the cleaner of FIG. 1.

FIG. 4 is a side elevational view of a wiper designed to be included as part of the cleaner of FIG. 1.

FIG. 4A is a side elevational view of a connector forming part of the wiper of FIG. 4.

DETAILED DESCRIPTION

Figure 1:
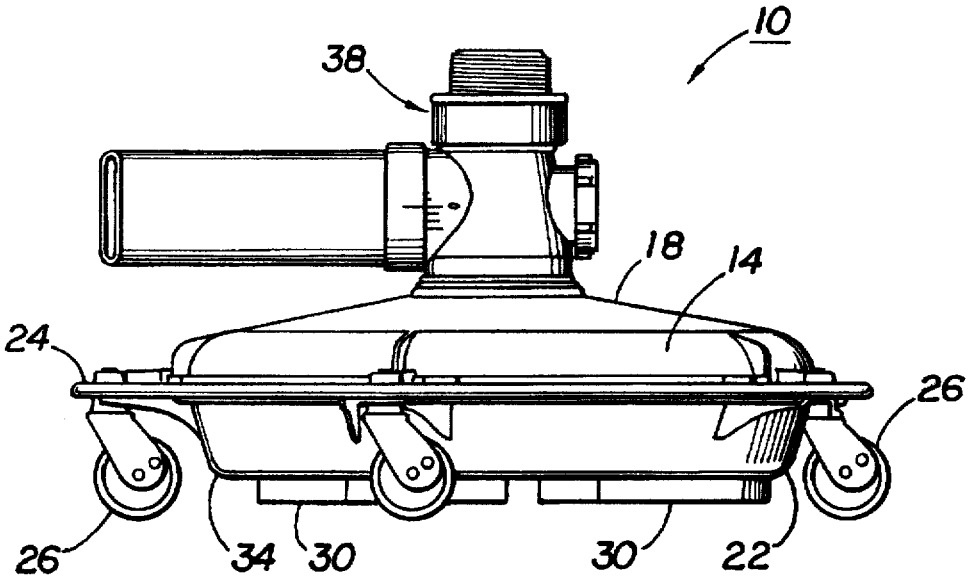
FIG. 1 is a side elevational view of a cleaner of the present invention.
Figure 2:
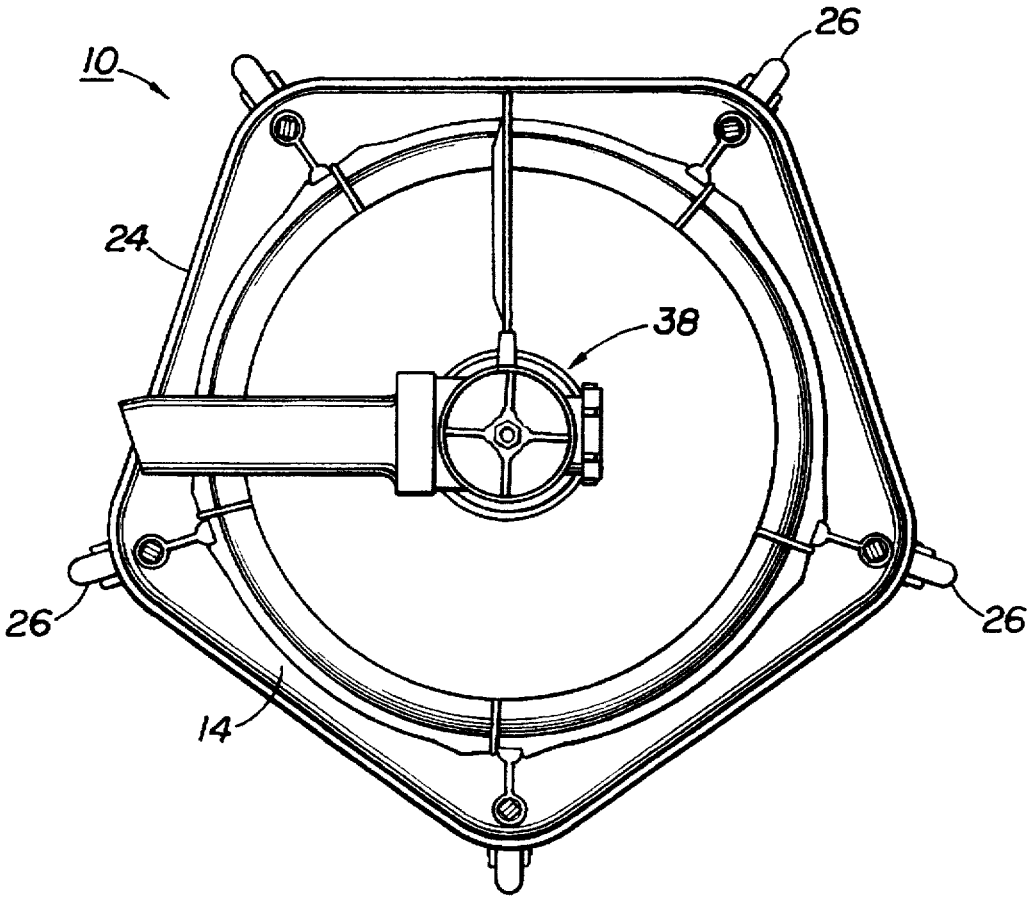
FIG. 2 is a top plan view of the cleaner of FIG. 1.

FIGS. 1–2 illustrate automatic swimming pool cleaner 10 of the present invention. Cleaner 10 includes body 14, comprising upper section 18 and lower section 22, which sections are fitted together in use. Shown in FIGS. 1–2 attached to lower section 22 about its periphery 24 are casters 26, while wipers 30 protrude from the bottom 34 of lower section 22. Connected to upper section 18 of body 14 is a hydro-injector 38 as described and illustrated in the Roumagnac patent. In use, cleaner 10 moves about a swimming pool or other vessel to be cleaned like the device of the Roumagnac patent.

Figure 5:
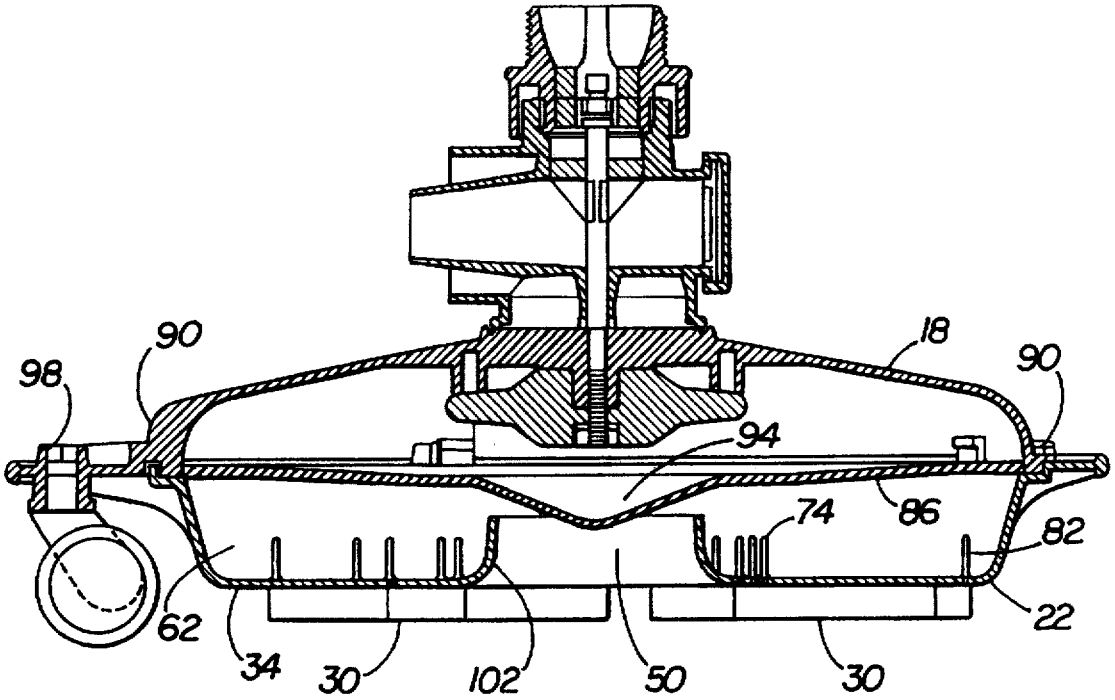
FIG. 5 is a cross-sectional view of the cleaner of FIG. 1.

FIGS. 3–5 detail the preferred placement of wipers 30 in cleaner 10. As detailed in FIGS. 3 and 5, lower section 18 include multiple openings 42 arranged in concentric circles 46 (shown as dotted lines) about central inlet 50. Selected sets of openings 42 define curves 54 (also shown as dotted lines), the preferred shape of wipers 30 in use. With wipers 30 so positioned on bottom 34 of lower section 22, all (or substantially all) radii 58 centered at central inlet 50 cross at least one wiper 30.

Wipers 30 thus spiral inward toward central inlet 50, causing water or other fluid encountering them to flow in the form of a vortex about central inlet 50 when cleaner 10 operates. Cooperating with the flat bottom 34 of lower section 22, wipers 30 function to accelerate fluid flow toward central inlet 50, increasing the likelihood that debris entrained in the flow will remain suspended therein until entering the interior 62 of body 14. Wipers 30 additionally effectively block fluid and debris from entering central inlet 50 without having been captured by the vortex.

Detailed in FIG. 4 is the nominal structure of wiper 30. Wiper 30 may be molded or otherwise formed of a flexible material such as plastic or rubber and comprise blade 66 and integrally-formed connectors 70. Each connector 70 of the type shown in FIG. 4 includes an elongated segment 74 terminating in flange assembly 78. Segment 74 has a diameter less than that of openings 42, facilitating its insertion therein, while flange assembly 78 includes flange 82 having a diameter greater than that of openings 42. Because wiper 30 is formed of compressible material, however, both segment 74 and flange 82 may be pulled through openings 42 into the interior 62 of body 14, after which flange 82 expands to lock wiper 30 in position. FIG. 5 illustrates wipers 30 as connected to lower section 22, with segment 74 and flange 82 protruding into interior 62.

Also shown in FIG. 5 is filter 86, which in some embodiments is a screen spanning lower section 22 within the interior 62 of body 14. Alternatively, filter 86 may be as described in the Roumagnac patent. In either event, filter 86 is designed to obstruct debris entrained in fluid entering central inlet 50 and retain the debris within interior 62. If desired, filter 86 may be fitted into or otherwise attached to lower section 22 or upper section 18 or, as illustrated in FIG. 5, placed on ledge 90 of the lower section 22 and retained using spring 94 extending from hydro-injector 38. Pins 98 connect casters 26 about the periphery 24 of lower section 22. Not encumbering upper section 18 with casters 26 facilitates removal of filter 86 from body 14, as the filter 86 becomes accessible merely by removing the unencumbered upper section 18.

Figure 6:
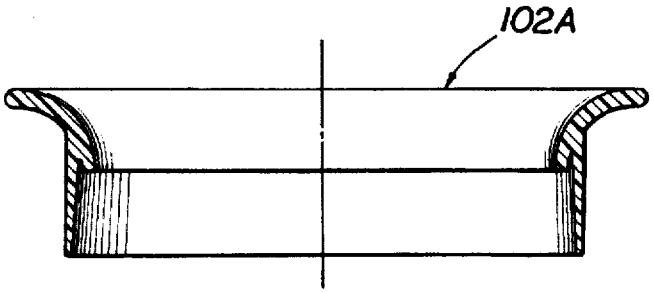
FIG. 6 is a cross-sectional view of a fluted throat that may be included as part of the cleaner of FIG. 1.

Throat 102 of lower section 22 defines central inlet 50. It additionally bounds the portion of interior 62 defined by lower section 22, reducing the possibility that debris settling therein can exit through central inlet 50 when hydro-injector 38 is not functioning. FIG. 6 illustrates an alternative throat 102A for cleaner 10. Unlike throat 102, throat 102A is fluted, providing an improved flow path for enhanced debris pick-up and forming an additional barrier to debris exiting interior 62 through central inlet 50 when not desired.

Figure 7:
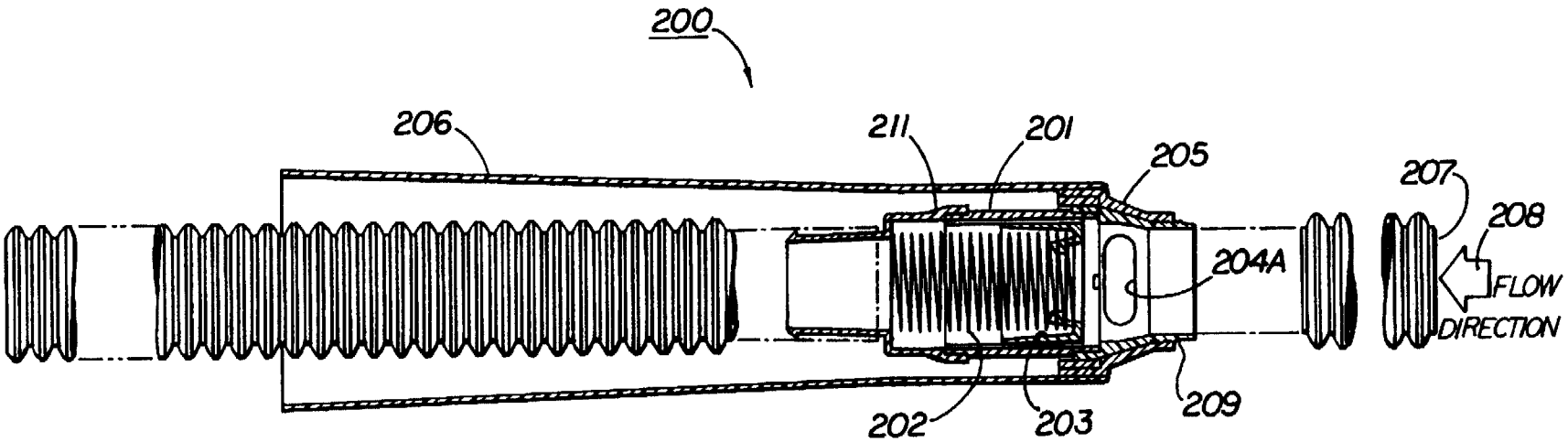
FIG. 7 is a partially-sectioned and -schematicized representation of a valve assembly forming part of the present invention and which may, if desired, be used in connection with the cleaner of FIG. 1.
Figure 8:
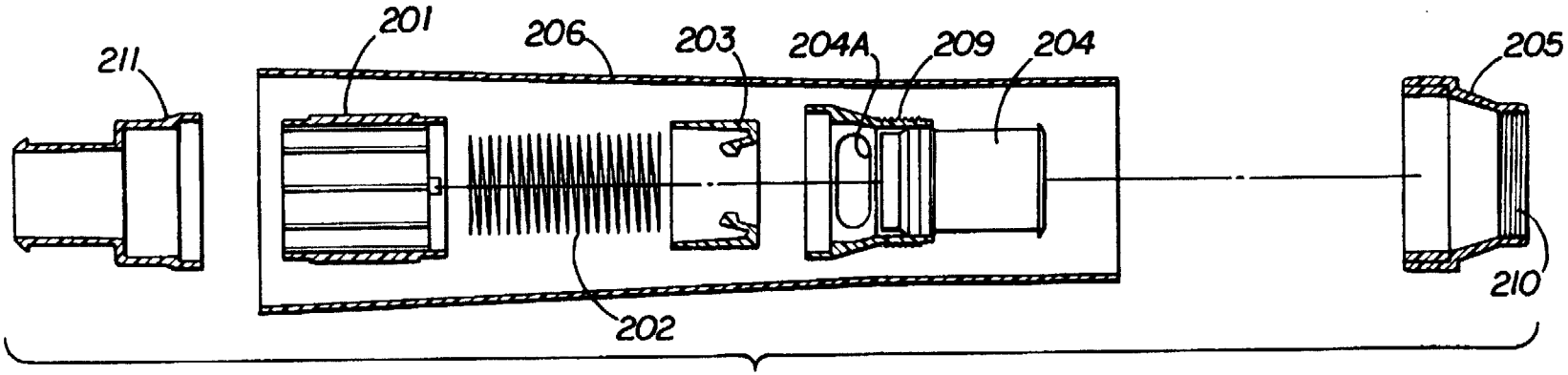
FIG. 8 is an exploded view of the valve assembly of FIG. 7.

FIGS. 7–8 disclose valve 200 which may be used to indicate and control the flow rate of fluid passing therethrough. Valve 200 includes tube 201 or other assembly, within which spring 202 and plunger 203 are positioned, as well as nozzle 204. Further shown in FIGS. 7–8 are nut 205, to which nozzle 204 attaches, diffuser 206, and fluid line 207 such as a corrugated hose. Included as part of nozzle 204 are one or more bypass ports 204A for diverting fluid into diffuser 206. Nozzle 204 also contains threaded section 209, which engages corresponding threaded section 210 of nut 205. Although valve 200 may be used in connection with cleaner 10 and an associated pump, it is not so limited and may be employed with other automatic swimming pool cleaning systems or used separately in any suitable fluid lines.

In use, fluid flows into valve 200 in the direction of arrow 208. Passing through nozzle 204, the fluid flow opposes the force of spring 202, causing the spring 202 to compress and attached plunger 203 to move. If tube 201 is partly or wholly transparent, the position of plunger 203 within the tube 201 may provide an indication external of the tube 201 of the rate of fluid flow through valve 200. Calibration using known equations for fluid and spring forces can permit the position of plunger 203 within tube 201 to evidence the flow rate of the fluid through the valve 200. The fluid continues to flow through exit adaptor 211 (when present) to fluid line 207, travelling to, for example, cleaner 10.

Nozzle 204, ports 204A, and nut 205 permit the fluid flow through valve 200 to be adjusted. Tightening nut 205 decreases the effective size of ports 204A, reducing the rate at which fluid is capable of exiting valve 200 through the ports 204A. By contrast, loosening nut 205 increases the effective size of ports 204A, permitting fluid to flow through ports 204A into diffuser 206 at a greater rate. The location of plunger 203 within tube 201 may be observed after each incremental change in the relative positions of nozzle 204 and nut 205, moreover, until the desired flow rate through valve 200 is achieved.

Fluid flowing through ports 204A enters diffuser 206, a tube or other analogous structure, that surrounds a portion of fluid line 207. In the embodiment of valve 200 shown in FIGS. 7–8, fluid line 207 is a corrugated hose, whose corrugations cooperate with diffuser 206 to decrease the velocity and pressure of the fluid within the diffuser 206. Although the corrugations are believed to facilitate the decrease in fluid velocity and pressure, fluid line 207 need not be a corrugated hose for diffuser 206 to operate, however. Furthermore, if corrugations are desired, they may be supplied by other structures such as exit adaptor 211.

Other embodiments of valve 200 may be fully automatic. In such cases ports 204A may be omitted from nozzle 204 and placed instead in tube 201. Movement of plunger 203 within tube 201 then will determine the effective area of ports 204A through which fluid may exit valve 200 through diffuser 206. With appropriate modifications valve 200 is also suitable for indicating and controlling the flow of fluid by suction into, for example, a pump. There, however, ports 204A would function to increase (rather than decrease) flow through valve 200, and diffuser 206 would serve as a vortex inhibitor instead of diffusing velocity and pressure.

The foregoing is provided for purposes of illustrating, explaining, and describing embodiments of the present invention. Modifications and adaptations to these embodiments will be apparent to those skilled in the art and may be made without departing from the scope or spirit of the invention.

We claim:

1. A system for cleaning a swimming pool having an associated pump, comprising:

a. an automatic swimming pool cleaner comprising:
   i. an upper section;
   ii. a lower section connected to the upper section and having a bottom defining a fluid inlet;
   iii. a plurality of wipers connected to the lower section and protruding from the bottom and spiraling inward toward the fluid inlet; and
   iv. a plurality of travel means affixed to the bottom which allow the cleaner to travel over a surface to be cleaned and in which the travel means extend a sufficient distance from the bottom to prevent the wipers from contacting the surface;

b. a valve comprising:
   i. a tube with a spring stop therein, the tube further defining an inlet and an outlet;
   ii. a spring with a first end and a second end positioned within the tube in which the first end is urged against the spring stop; and
   iii. a plunger positioned within the tube and urged against the second end of the spring; and c. means, through which fluid may flow, for connecting the valve to the pump and automatic swimming pool cleaner such that fluid may flow through the valve between the automatic swimming pool cleaner and the pump.

2. An automatic swimming pool cleaner having a bottom and a plurality of bladed wipers protruding from the bottom in which:

a. the bottom further defines a fluid inlet and plurality of openings each having a diameter; and b. the bladed wipers spiral inward toward the fluid inlet, each of the bladed wipers further comprising:
   i. the blade protruding from the bottom;
   ii. an elongated section positioned within and having a diameter less than that of a corresponding opening of the plurality of openings; and
   iii. a compressible flange connecting the elongated section to the blade and having a nominal diameter greater than that of the corresponding opening, which diameter decreases as the flange compresses for insertion through the corresponding opening and increases once the elongated section is positioned within the corresponding opening, thereby holding the wiper against the bottom.

3. An automatic swimming pool cleaner according to claim 2 in which the bottom comprises a fluted throat which further defines the fluid inlet.

4. An automatic swimming pool cleaner according to claim 3 having an interior and further comprising:

a. an upper section defining a fluid exit;

b. a lower section connected to the upper section; thereby defining the interior of the automatic swimming pool cleaner; and c. a filter positioned within the interior of the automatic swimming pool cleaner such that substantially all fluid entering the fluid inlet passes through the filter before exiting the automatic swimming pool cleaner.

5. An automatic swimming pool cleaner according to claim 4 further comprising:

a. a hydro-injector connected to the upper section; and b. a spring protruding from the hydro-injector and biasing the filter toward the bottom.

6. An automatic cleaner for cleaning a surface of a swimming pool comprising:

a. a body having a bottom;

b. a throat integrally formed with the bottom and defining a fluid inlet;

c. a plurality of wipers, each wiper having a length and being continuous and unbroken along its entire length, protruding from the bottom and spiraling inward towards the fluid inlet such that debris cannot enter the inlet without having been captured by a vortex generated by the wipers; and d. a plurality of travel means affixed to the bottom and extending a sufficient distance from the bottom to prevent the wipers from contacting the surfaces.

7. An automatic swimming pool cleaner according to claim 6 in which the wipers are bladed.

8. An automatic swimming pool cleaner comprising:

a. a body having a bottom;

b. a fluted throat integrally formed with the bottom and defining a fluid inlet; and c. a plurality of wipers, each wiper having a length and being continuous and unbroken along its entire length, protruding from the bottom and spiraling inward towards the fluid inlet such that debris cannot enter the inlet without having been captured by a vortex generated by the wipers.

9. An automatic swimming pool cleaner according to claim 8 in which the bottom is flat.

10. An automatic cleaner for cleaning surfaces of a pool having a bottom, a central inlet defined in the bottom and a plurality of bladed wipers, each wiper having a length and protruding from the bottom, in which the wipers are arranged in a spiral pattern around the inlet such that any radii of the cleaner centered at the inlet will cross at least one wiper, in which each wiper is continuous and unbroken along its length, and a plurality of travel means affixed to the bottom and extending a sufficient distance from the bottom to prevent the bladed wipers from contacting the surfaces.

11. An automatic swimming pool cleaner having a bottom, a central inlet defined in the bottom and a plurality of bladed wipers, each wiper having a length and protruding from the bottom, in which the wipers are arranged in a spiral pattern around the inlet such that any radii of the cleaner centered at the inlet will cross at least one wiper, in which each wiper is continuous and unbroken along its length and in which a fluted throat surrounds the inlet.

12. An automatic cleaner for cleaning surfaces of a pool comprising:

a. a body having a top surface and a bottom surface in which the bottom surface defines a central inlet therein;

b. a plurality of bladed wipers for accelerating a fluid flow toward the central inlet and generating a vortex about the inlet in which the wipers are arranged in a spiral pattern about the central inlet such that that any radii of the cleaner centered at the inlet will cross at least one wiper; and c. means, affixed to the bottom surface, for suspending the cleaner sufficiently above the pool surface to prevent the wipers from contacting the pool surface.

13. A system for cleaning a swimming pool having an associated pump, comprising;

a. an automatic swimming pool cleaner comprising:
   i. an upper section;
   ii. a lower section connected to the upper section and having a bottom defining a fluid inlet;
   iii. a plurality of wipers connected to the lower section and protruding from the bottom and spiraling inward toward the fluid inlet;

b. a valve comprising:

i. a tube with a spring stop therein, a portion of the tube being at least partially transparent, the tube further defining an inlet and an outlet;

ii. a spring with a first end and a second end positioned within the tube in which the first end is urged against the spring stop; and iii. a plunger positioned within the tube such that the plunger is visible through the at least partially transparent portion and urged against the second end of the spring;

iv. means, connected to the inlet and independent of the position of the plunger and which is manually adjustable, for regulating the flow of fluid through the valve; and c. means, through which fluid may flow, for connecting the valve to the pump and automatic swimming pool cleaner such that fluid may flow through the valve between the automatic swimming pool cleaner and the pump.

* * * * *